US008359867B2

(12) United States Patent
Chila et al.

(10) Patent No.: US 8,359,867 B2
(45) Date of Patent: Jan. 29, 2013

(54) COMBUSTOR HAVING A FLOW SLEEVE

(75) Inventors: Ronald James Chila, Greer, SC (US); Martin Ronald Watts, Greer, SC (US); Sheng-Yi Wu, Greer, SC (US)

(73) Assignee: General Electric Company, Schenectady, NY (US)

( * ) Notice: Subject to any disclaimer, the term of this patent is extended or adjusted under 35 U.S.C. 154(b) by 225 days.

(21) Appl. No.: 12/756,329

(22) Filed: Apr. 8, 2010

(65) Prior Publication Data

US 2011/0247339 A1 Oct. 13, 2011

(51) Int. Cl.
*F02C 1/00* (2006.01)
*F02G 3/00* (2006.01)

(52) U.S. Cl. ..... 60/752; 60/754; 60/755; 60/756; 60/757; 60/760; 60/758

(58) Field of Classification Search ..... 60/752, 60/754–758, 760
See application file for complete search history.

(56) References Cited

U.S. PATENT DOCUMENTS

| | | | | |
|---|---|---|---|---|
| 4,719,748 | A | 1/1988 | Davis et al. | |
| 6,484,505 | B1 | 11/2002 | Brown et al. | |
| 7,007,482 | B2 * | 3/2006 | Green et al. | 60/752 |
| 7,010,921 | B2 | 3/2006 | Intile et al. | |
| 7,082,770 | B2 * | 8/2006 | Martling et al. | 60/796 |
| 7,493,767 | B2 | 2/2009 | Bunker et al. | |
| 7,571,611 | B2 | 8/2009 | Johnson et al. | |
| 7,574,865 | B2 | 8/2009 | Bland | |
| 7,707,835 | B2 * | 5/2010 | Lipinski et al. | 60/752 |
| 7,878,002 | B2 * | 2/2011 | Poyyapakkam | 60/752 |
| 8,051,663 | B2 * | 11/2011 | Tuthill | 60/755 |
| 2005/0144953 | A1 * | 7/2005 | Martling et al. | 60/752 |
| 2006/0283189 | A1 | 12/2006 | Lipinski et al. | |
| 2009/0044540 | A1 * | 2/2009 | Pangle et al. | 60/752 |
| 2009/0139238 | A1 | 6/2009 | Martling et al. | |
| 2009/0282833 | A1 * | 11/2009 | Hessler et al. | 60/757 |
| 2010/0223931 | A1 * | 9/2010 | Chila et al. | 60/760 |

FOREIGN PATENT DOCUMENTS

| | | | |
|---|---|---|---|
| EP | 2228602 | A2 | 9/2010 |
| JP | 08270947 | A | 10/1996 |

OTHER PUBLICATIONS

European Search Report Application No. 11161552.2-1266/2375161 dated May 23, 2012; 6 pages.

* cited by examiner

*Primary Examiner* — William H Rodriguez
*Assistant Examiner* — Craig Kim
(74) *Attorney, Agent, or Firm* — Cantor Colburn LLP

(57) ABSTRACT

A combustor is provided and includes a liner through which fluid fed from at least two injection points flows from a head end to an interior of a transition piece, a first one of the at least two injection points being axially proximate to a fluid impenetrable coupling between the liner and the transition piece and defining apertures disposed in fluid communication with a first passage leading to the head end, and a second one of the at least two injection points being disposed axially between the apertures and the head end and upstream from the apertures relative to a direction of fluid flow through the first passage, the second one of the at least two injection points being formed of openings disposed in fluid communication with a second passage leading to the head end.

14 Claims, 3 Drawing Sheets

COMBUSTOR HAVING A FLOW SLEEVE

BACKGROUND OF THE INVENTION

The subject matter disclosed herein relates to a combustor having a flow sleeve.

In turbine engines and, in particular, gas turbine engines, fuels, such as gas and compressed air, are fed to a combustor where combustion thereof occurs. High temperature fluids generated from this combustion are then directed through a transition piece and into a turbine for power and/or electricity generation. Generally, the compressed air is fed to the combustor from a plenum disposed in fluid communication with a compressor and with a combustor casing. This compressed air is forced to travel upstream from the plenum toward the head end where it is mixed with the other fuels.

Often, the compressed air is used for impingement cooling of the transition piece before it is directed toward the head end. Whether this is the case or not, the compressed air is admitted to a flow path proximate to the transition piece. As this occurs, however, a pressure of the compressed air must be maintained in order for complete air/fuel mixing to occur.

BRIEF DESCRIPTION OF THE INVENTION

According to one aspect of the invention, a combustor is provided and includes a liner through which fluid fed from at least two injection points flows from a head end to an interior of a transition piece, a first one of the at least two injection points being axially proximate to a fluid impenetrable coupling between the liner and the transition piece and defining apertures disposed in fluid communication with a first passage leading to the head end, and a second one of the at least two injection points being disposed axially between the apertures and the head end and upstream from the apertures relative to a direction of fluid flow through the first passage, the second one of the at least two injection points being formed of openings disposed in fluid communication with a second passage leading to the head end.

According to another aspect of the invention, a combustor is provided and includes a liner through which fluid fed from at least two injection points flows from a head end to an interior of a transition piece, a first one of the at least two injection points being axially proximate to a fluid impenetrable coupling between the liner and the transition piece and defining apertures disposed in fluid communication with a first passage leading to the head end, and a second one of the at least two injection points being disposed axially between the apertures and the head end and upstream from the apertures relative to a direction of fluid flow through the first passage, the second one of the at least two injection points being formed of openings disposed in fluid communication with a second passage leading to the head end, whereby fluid entering and flowing through the second passage via the opening stratifies and thereby maintains a pressure of fluid entering and flowing through the first passage via the apertures.

According to yet another aspect of the invention, a combustor is provided and includes a liner through which first fluid flows from a head end to an interior of a transition piece, a first sleeve disposed about respective portions of the liner, the transition piece and a fluid impenetrable coupling thereof to define a first passage, the first sleeve being coupled to the transition piece and having apertures formed therein through which second fluid is injected into the first passage toward the head end and a second sleeve disposed about the first sleeve to define a second passage into which third fluid is injected toward the head end such that a pressure of the second fluid is substantially maintained along a length of the first passage.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

In accordance with aspects, a combustor is provided with a flow sleeve that achieves a low pressure drop of compressed air that is directed toward a combustor head end, while maintaining convective cooling for a combustor liner. In particular, a first axial feed is provided via a series of circular apertures which can be of any size and may include edge treatments along with a second axial feed that increases an effectiveness of the first axial feed.

Figure 1:
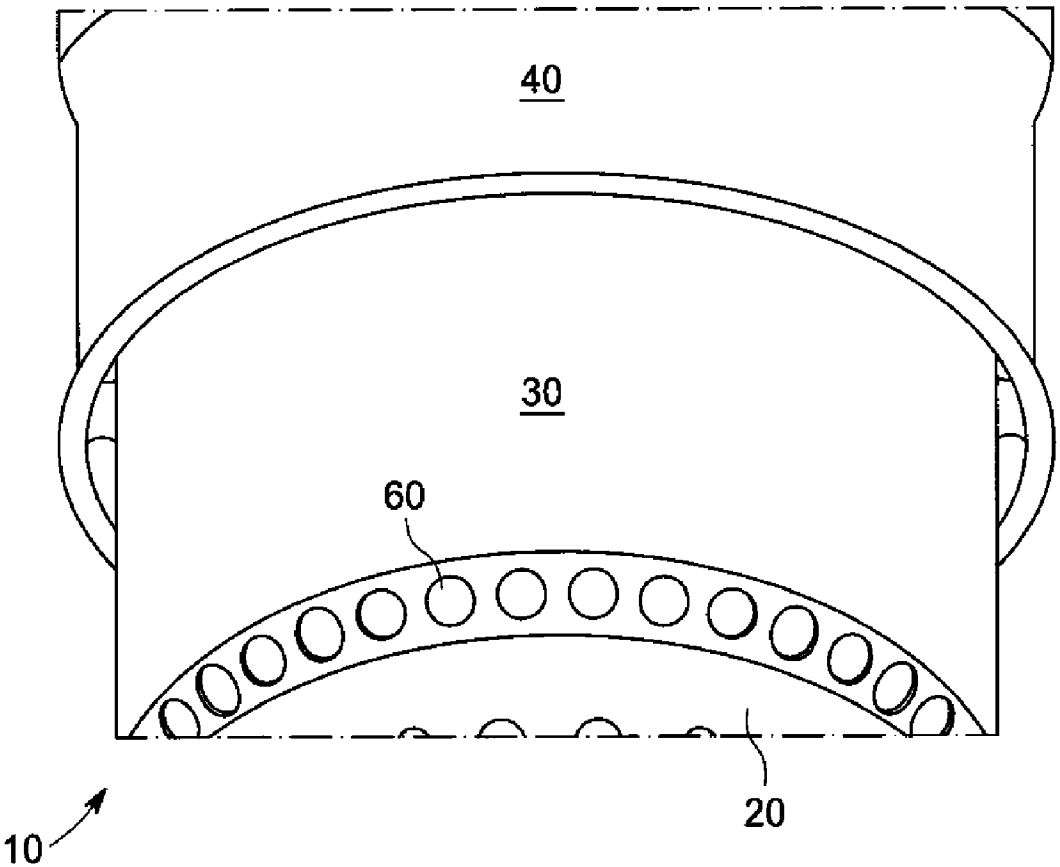
FIG. 1 is a side view of a flow sleeve and a combustor liner of a combustor.
Figure 2:
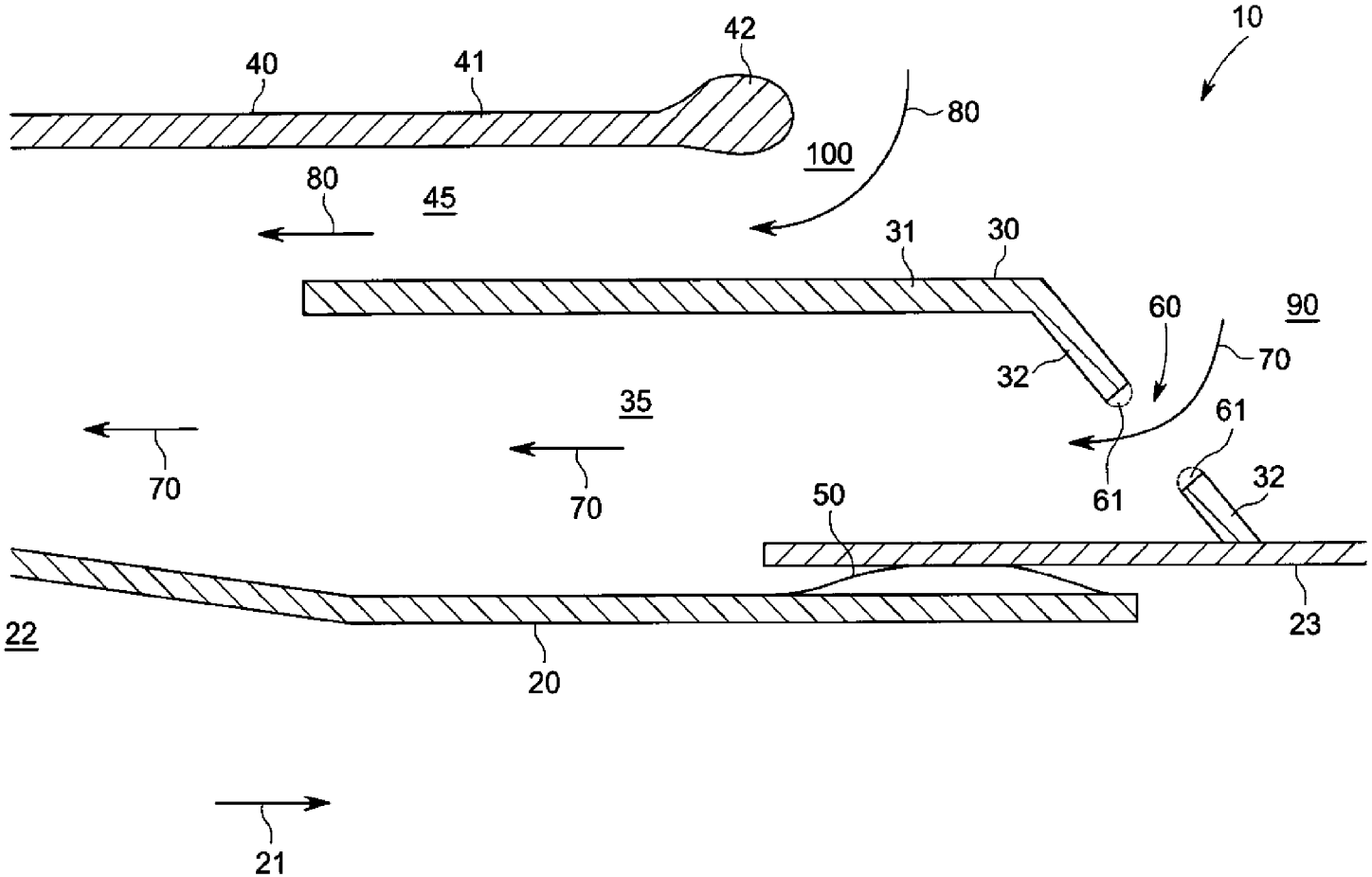
FIG. 2 is a cross sectional view of the flow sleeve and the combustor liner of FIG. 1.

With reference to FIGS. 1 and 2, a combustor 10 is provided and includes a combustor liner 20 through which a first fluid 21, such as high temperature gas, flows from a head end 22 to an interior of a transition piece 23, a first flow sleeve 30 and a second flow sleeve 40. The transition piece 23 may or may not be cooled by impingement cooling provided by a supply of compressed air. The first flow sleeve 30 is disposed about respective portions of the combustor liner 20 and the transition piece 23 and a fluid impenetrable coupling 50. The fluid impenetrable coupling 50 may be a seal, such as a hula seal or some other similar type of sealant, which is sealably interposed between the combustor liner 20 and the transition piece 23 such that the combustor liner 20 and the transition piece 23 are disposed in fluid communication with one another.

The first flow sleeve 30 is sealably coupled to an outer surface of the transition piece 23 and thereby defines a first passage 35 between an inner surface thereof and outer surfaces of the combustor liner 20 and the transition piece 23. The first flow sleeve 30 has apertures 60 defined therein through which a second fluid 70 flowing in a predominantly axial direction toward the head end 22 is injected into the first passage 35.

The second flow sleeve 40 is supported to be disposed about the first flow sleeve 30 to define a second passage 45 between an inner surface thereof and outer surfaces of the first flow sleeve 30 and the combustor liner 20. A third fluid 80 is injected into the second passage 45 via openings 100 of the second passage 45 to define a flow of the third fluid 80. The third fluid 80 then flows in a predominantly axial direction toward the head end 22. The openings 100 are disposed axially between the apertures 60 and the head end 22 and upstream from the apertures 60 relative to a direction of fluid flow through the first passage 35.

The first passage 35 and the second passage 45 join at an axial location proximate to the head end 22 such that the third fluid 80 and the second fluid 70 comingle and otherwise interact with one another. An effect of this fluid interaction is that the flow of the third fluid 80 stratifies the flow of the second fluid 70 resulting in a pressure of the second fluid 70 being substantially maintained along at least a partial length of the first passage 35. That is, a pressure drop of the second fluid 70 as the second fluid 70 proceeds from region 90 along the first passage 35 and toward the head end 22 is prevented or at least substantially reduced. The maintenance of the pressure of the second fluid may be further provided by modifications of the flow of the third fluid 80, which may include a thickening or narrowing of the first and/or second passages 35, 45 and/or a positioning of turbulators or other similar devices within the first and/or second passages 35, 45.

The combustor liner 20, the first flow sleeve 30 and the second flow sleeve 40 may be substantially coaxial and/or substantially parallel with one another in some axial locations although this is not required and embodiments exist in which this is not the case. In addition, the combustor liner 20, the first flow sleeve 30 and the second flow sleeve 40 may each be substantially tubular. In this way, the first and second passages 35 and 45 may each be substantially annular.

The first flow sleeve 30 may include a first sleeve portion 31 and a frusto-conical portion 32. The frusto-conical portion 32 is sealed or otherwise coupled to an edge of the first sleeve portion 31 and to the transition piece 23 and is formed to define the apertures 60. The apertures 60 are axially proximate to an axial location of the fluid impenetrable coupling 50 although this is not required and embodiments exist in which the apertures 60 are displaced from this axial location.

The apertures 60 may be arrayed perimetrically about the combustor liner 20 in substantial radial alignment with one another. The apertures 60 may, in some cases, be similarly shaped and sized and, in other cases, each aperture 60 may have a unique shape and size. As an example, the apertures 60 may each be ovoid or circular. They may additionally include edge treatments 61 to disturb the flow of the second fluid 70 to thereby cause a further reduction in the pressure drop thereof.

The second flow sleeve 40 may include a second sleeve portion 41 and a flange 42. The flange 42 extends radially outwardly from the second sleeve portion 41 and forms the opening 100 as being a bell mouth opening at the entrance to the second passage 45.

Figure 3:
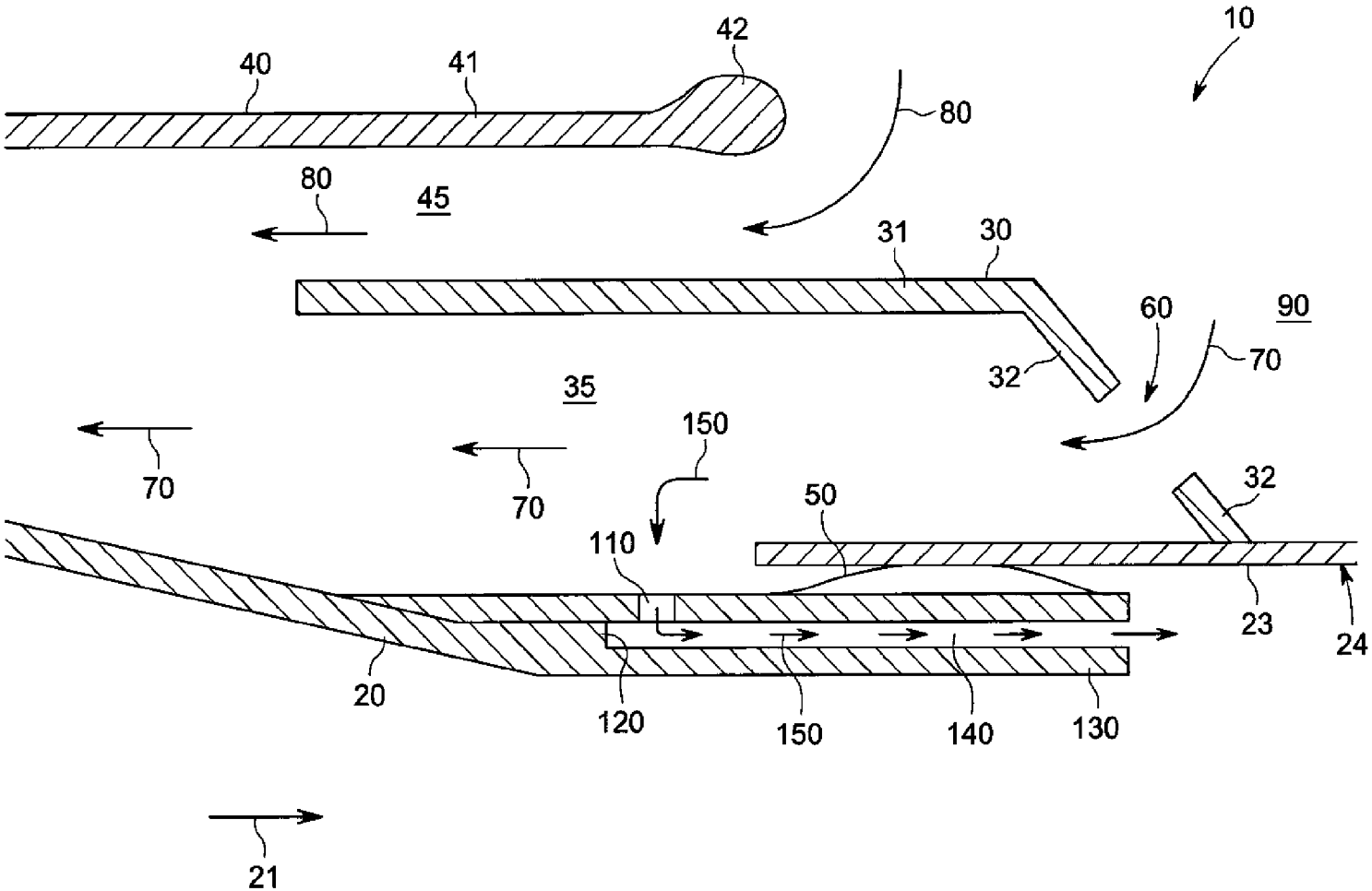
FIG. 3 is a cross sectional view of another embodiment of the flow sleeve and the combustor liner of FIG. 1.

With reference to FIG. 3, the combustor liner 20 may be formed to define a radial aperture 110, which is disposed in fluid communication with the first passage 35. In this case, an interior flange 120 may be coupled to an interior surface of the combustor liner 20 and a baffle 130 may be coupled to the interior flange 120. Both the interior flange 120 and the baffle 130 may be annular and extend circumferentially about a centerline of the combustor liner 20. Moreover, the baffle 130 may be formed with respect to the combustor liner 20 to define a cooling channel 140 into which a portion 150 of the second fluid 70, which is directed to flow radially inwardly through the radial aperture 110, is injected toward the interior of the transition piece 23.

As shown in FIG. 3, the portion 150 of the second fluid 70 injected toward the interior of the transition piece 23 is directed to be interposed between the first fluid 21 and an interior surface 24 of the transition piece 23. In this way, the portion 150 of the second fluid 70, which is relatively cool as compared to a temperature of the first fluid 21, serves as a barrier fluid layer between the interior surface 24 and the first fluid 21, which can prevent or at least substantially reduce damage to the transition piece 23 due to impingement thereon of the relatively high temperature first fluid 21.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor, comprising:

a liner through which first fluid flows from a head end to an interior of a transition piece;

a first sleeve disposed about respective portions of the liner, the transition piece and a fluid impenetrable coupling thereof to define a first passage having an axially elongate portion, the first sleeve being coupled to the transition piece and having apertures defined therein through which second fluid is injected into the first passage toward the head end; and a second sleeve disposed about the first sleeve to define a second passage having a second axially elongate portion and an entrance disposed axially between aft and forward edges of the first sleeve portion and into which third fluid is injected at the entrance such that the third fluid flows through the second axially elongate portion and toward the head end such that a pressure of the second fluid is substantially maintained along a length of the first passage, the second axially elongate portion of the second passage being disposed about the first axially elongate portion of the first passage, the first sleeve comprising a first sleeve portion and a frusto-conical portion defining the apertures and being coupled to an aft edge of the first sleeve portion and to the transition piece.

2. The combustor according to claim 1, wherein portions of the liner and the first and second sleeves are substantially coaxial.

3. The combustor according to claim 1, wherein portions of the liner and the first and second sleeves are each substantially tubular and the first and second passages are each substantially annular.

4. The combustor according to claim 1, wherein the fluid impenetrable coupling comprises sealant interposed between the respective portions of the liner and the transition piece.

5. The combustor according to claim 1, wherein the apertures are disposed axially proximate to the fluid impenetrable coupling.

6. The combustor according to claim 1, wherein the apertures are arrayed perimetrically about the liner.

7. The combustor according to claim 1, wherein the apertures are radially aligned with one another.

8. The combustor according to claim 1, wherein the apertures are substantially ovoid.

9. The combustor according to claim 1, further comprising edge treatments disposed at the apertures to disturb a flow of the second fluid.

10. The combustor according to claim 1, wherein the second sleeve comprises a bell mouth shaped opening at an entrance to the second passage.

11. The combustor according to claim 1, wherein the liner is formed to define a radial aperture in fluid communication with the first passage and comprises:

a flange coupled to an interior surface of the liner; and a baffle coupled to the flange and formed to define a cooling channel into which a portion of the second fluid, which is directed to flow through the radial aperture, is injected toward the transition piece interior.

12. The combustor according to claim 11, wherein the portion of the second fluid injected toward the transition piece interior is interposed between the first fluid and an interior surface of the transition piece.

13. The combustor according to claim 1, wherein an aft portion of the first sleeve portion is coaxial with a forward portion of the transition piece and a forward portion of the first sleeve portion is coaxial with an aft portion of the second sleeve.

14. The combustor according to claim 13, wherein the aft portion of the second sleeve comprises a bell mouth shaped opening at an entrance to the second passage.

* * * * *